US005846921A

United States Patent [19]

Gil et al.

[11] Patent Number: 5,846,921

[45] Date of Patent: Dec. 8, 1998

[54] SEMICONDUCTOR SUBSTRATE CLEANING SOLUTIONS, METHODS OF FORMING THE SAME, AND METHODS USING THE SAME

[75] Inventors: June-ing Gil; Seok-ho Yi; Sang-mun Chon, all of Kyungki-do; Ho-kyoon Chung, Seoul, all of Rep. of Korea

[73] Assignee: Samsung Electronics Co., Ltd., Suwon, Rep. of Korea

[21] Appl. No.: 805,210

[22] Filed: Feb. 27, 1997

[30] Foreign Application Priority Data

Mar. 7, 1996 [KR] Rep. of Korea ..... 96-5954

[51] Int. Cl.[6] ..... C11D 7/54; C11D 7/26; C11D 7/28; B08B 3/08

[52] U.S. Cl. ..... 510/175; 510/375; 510/370; 134/2; 134/3; 134/1.3; 134/41; 134/42

[58] Field of Search ..... 510/175, 176, 510/375, 370; 134/2, 38, 42, 1.3, 3, 41

[56] References Cited

U.S. PATENT DOCUMENTS

| | | | |
|---|---|---|---|
| 4,695,327 | 9/1987 | Grebinski | 134/11 |
| 4,746,397 | 5/1988 | Maeda et al. | 156/637 |
| 4,759,823 | 7/1988 | Asselanis et al. | 156/659.1 |
| 5,037,485 | 8/1991 | Chromecek et al. | 134/7 |
| 5,259,888 | 11/1993 | McCoy | 134/2 |
| 5,350,489 | 9/1994 | Muraoka | 156/651 |
| 5,466,389 | 11/1995 | Ilardi et al. | 252/156 |
| 5,498,293 | 3/1996 | Ilardi et al. | 134/3 |
| 5,516,730 | 5/1996 | Saeed et al. | 437/235 |
| 5,571,337 | 11/1996 | Mohindra et al. | 134/25.4 |
| 5,571,375 | 11/1996 | Izumi et al. | 156/646.1 |
| 5,571,419 | 11/1996 | Obata et al. | 210/664 |
| 5,634,978 | 6/1997 | Mohindra et al. | 134/2 |
| 5,656,097 | 8/1997 | Olesen et al. | 134/1 |

FOREIGN PATENT DOCUMENTS 206272 7/1984 Czechoslovakia .

*Primary Examiner*—Douglas J. McGinty
*Attorney, Agent, or Firm*—Myers Bigel Sibley & Sajovec, PA

[57] ABSTRACT

Cleaning solutions for application to semiconductor substrates comprise hydrofluoric acid, hydrogen peroxide, isopropyl alcohol, and water. Methods of cleaning semiconductor substrates comprise contacting the semiconductor substrates having contaminants contained thereon with cleaning solutions comprising hydrofluoric acid, hydrogen peroxide, isopropyl alcohol, and water; contacting the semiconductor substrates with first baths of water to remove the cleaning solutions contained on the semiconductor substrates; contacting the semiconductor substrates with second baths containing water to remove the contaminants contained on the semiconductor substrates; and rotating the semiconductor substrates to remove water remaining thereon to clean the semiconductor substrates.

12 Claims, 1 Drawing Sheet

SEMICONDUCTOR SUBSTRATE CLEANING SOLUTIONS, METHODS OF FORMING THE SAME, AND METHODS USING THE SAME

FIELD OF THE INVENTION

The present invention relates to solutions for cleaning semiconductor substrates, methods of using the same, and methods of forming the same. More specifically, the invention relates to solutions which clean the surfaces of the semiconductor substrates while preserving the characteristics of the surfaces.

BACKGROUND OF THE INVENTION

As semiconductor devices become increasingly integrated, the size of the corresponding patterns and the intervals between the patterns in the devices generally becomes smaller. Accordingly, in manufacturing processes of semiconductor devices having fine patterns, cleaning processes for removing contaminants from semiconductor substrates (i.e, wafer surfaces) typically play an important role. More specifically, when contaminants are present on the wafer surfaces, abnormal pattern profiles are often observed. Additionally, the presence of contaminants between fine patterns formed on conductive films often result in malfunction of the semiconductor devices. Therefore, it is desirable to remove contaminants which are present on wafer surfaces in order to enhance the yield rates and the reliability of highly integrated semiconductor devices.

Typically, two types of solutions have been employed to clean wafer surfaces. One solution contains hydrochloric acid (HCl), and the second solution contains ammonium hydroxide ($NH_4OH$). The first-mentioned cleaning solution is usually a mixed solution containing hydrochloric acid (HCl), hydrogen peroxide, and deionized water having a preferred volume ratio of 1 to 1 to 6, respectively. The second-mentioned cleaning solution is usually a mixed solution containing ammonium hydroxide, hydrogen peroxide, and deionized water having a preferred volume ratio of 1 to 4 to 20. The first cleaning solution is typically effective for removing inorganic impurities, while the second cleaning solution is typically effective for removing organic impurities.

A cleaning process utilizing the first cleaning solution is usually carried out by first dipping a contaminated wafer in the cleaning solution for a predetermined period of time to remove impurities (i.e., inorganic impurities) from the wafer surface. Subsequently, the wafer is dipped in deionized water to remove any cleaning solution which is present on the wafer surface. This step is conventionally referred to as a quick dump rinse (QDR) process. Next, the wafer is dipped in a dilute solution of hydrofluoric acid to remove inorganic impurities present on the wafer surface, and the wafer is then taken through the above QDR process to remove hydrofluoric acid solution which may be present on the wafer surface. Subsequently, a rinse process using deionized water may be carried out with the wafer to remove contaminants and cleaning solution present on the wafer surface. Finally, the wafer is generally rotated in a spin drying process to remove the deionized water present on the wafer surface. In this process, the wafer is generally exposed to air after each step. Moreover, it may be difficult to remove organic impurities using this process.

A cleaning process using the second cleaning solution containing ammonium hydroxide is typically carried out by employing the steps described above, with the exception that organic impurities are removed from the wafer surface. Additionally, the second cleaning solution can generally more effectively remove metal ion contaminants such as Na and Cu in comparison to the first cleaning solution. Nonetheless, in instances where the second cleaning solution is used to clean a wafer formed of silicon, or a wafer with a silicon surface film containing polysilicon or amorphous silicon, the silicon material is often etched by the ammonium hydroxide solution. This may be disadvantageous in that the thickness of the wafer typically decreases and the wafer surface may become rough. As a result, the characteristics of the semiconductor device may deteriorate.

In a specific embodiment, an MOS transistor may have a contact hole formed on its source and drain region which contains contaminants thereon. When the second cleaning solution is used, portions of the source and drain regions often are etched. As a result, the junction depth of the source and drain region exposed by the contact hole may decrease. This is undesirable since aluminum interconnections which cover the contact hole can readily penetrate the semiconductor substrate which is present below the source and drain region, and thus may adversely affect the reliability of the semiconductor device. The reliability is often adversely affected in highly integrated semiconductor devices which require source and drain regions with shallow junctions.

As mentioned above, when surfaces of semiconductor substrates or silicon films are cleaned using the second cleaning solution, the surfaces of the substrates or films may become rough. This is particularly true in instances involving surfaces of substrates where channel regions of MOS transistors are to be formed, or where the surfaces of silicon films are used for storage electrodes of cell capacitors for DRAM devices. As a result, when a gate insulating film or a dielectric film of a capacitor is formed on a rough surface, the characteristics of the films typically deteriorate. The breakdown voltage of the gate insulating film or the dielectric film often decreases, and simultaneously the leakage current may increase.

Disadvantageously, the reliability of the above semiconductor devices may deteriorate under such conditions.

In general, conventional solutions used in cleaning semiconductor devices may suffer from several drawbacks. In particular, when employing a solution which is acidic (containing HCl for example) or a solution which is alkaline (containing $NH_4OH$ for example), pipes of a wet station or other related components can become corroded, and the life span of such equipment thus may be shortened. Moreover, since a wafer is generally exposed to air during the cleaning process, a number of contaminants typically adhere to the wafer surface. As a result, the efficiency of the cleaning process may be adversely affected. With respect to using a cleaning solution containing hydrochloric acid, it is often difficult to remove organic impurities present on the wafer. A cleaning solution using ammonium hydroxide may be able to effectively remove the organic impurities, but such a solution typically etches the wafer, which may adversely affecting the reliability of the semiconductor device.

SUMMARY OF THE INVENTION

In view of the above, it is an object of the present invention to provide cleaning solutions for semiconductor substrates which can clean substrates while preserving the characteristics of the substrate film surfaces.

It is also an object of the present invention to provide methods of cleaning semiconductor substrates using the cleaning solutions.

These and other objects, features, and advantages of the present invention are provided by cleaning solutions for application to semiconductor substrates. The cleaning solutions comprise hydrofluoric acid, hydrogen peroxide, isopropyl alcohol, and water. Preferably, deionized water is employed in the cleaning solutions.

The cleaning solutions may contain various amounts of the components. In one embodiment, hydrogen peroxide is present in the cleaning solutions in volume ratios ranging from about 5:1 to about 15:1 based on the volume of the hydrofluoric acid. In another embodiment, isopropyl alcohol is present in the cleaning solutions in volume ratios ranging from about 40:1 to about 60:1 based on the volume of the hydrofluoric acid. In another embodiment, water is present in the cleaning solutions in volume ratios ranging from about 40:1 to about 60:1 based on the volume of the hydrofluoric acid.

The invention also relates to methods of cleaning semiconductor substrates. The methods comprise contacting semiconductor substrates having contaminants contained thereon with cleaning solutions comprising hydrofluoric acid, hydrogen peroxide, isopropyl alcohol, and water. Next, the semiconductor substrates are contacted with first baths of water to remove the cleaning solutions contained on the semiconductor substrates.

Subsequently, the semiconductor substrates are contacted with second baths of water to remove the contaminants contained on the semiconductor substrates. Finally, the semiconductor substrates are rotated to remove water remaining thereon to clean the semiconductor substrates.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE PREFERRED EMBODIMENTS

Figure 1:
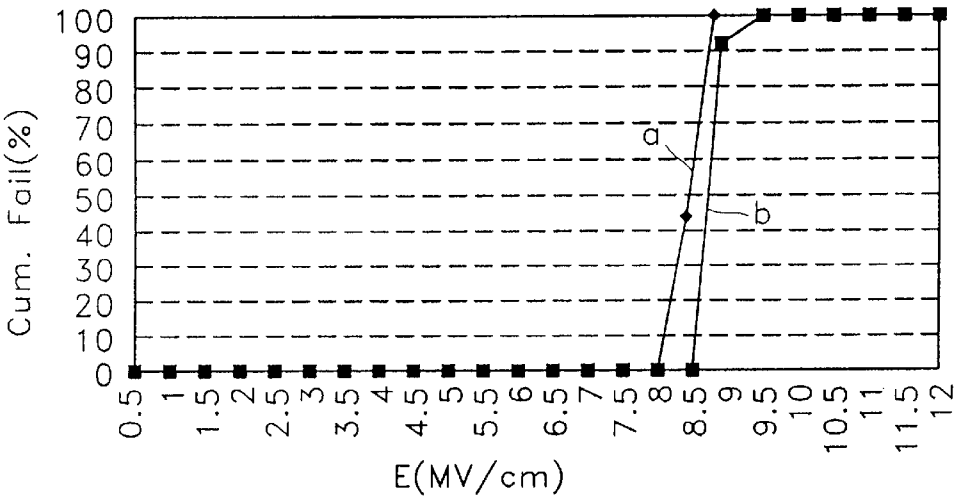
FIG. 1 is a graph illustrating breakdown voltage characteristics of dielectric films formed on semiconductor substrates by virtue of using conventional cleaning processes and cleaning processes of the present invention.

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art.

The invention relates to cleaning solutions for application to semiconductor substrates. The cleaning solutions comprise hydrofluoric acid, hydrogen peroxide, isopropyl alcohol, and water. Preferably, deionized water is used. The cleaning solutions of the present invention preferably comprise mixtures of solutions. Each of the solutions in the mixtures may contain one or more of the various components. The cleaning solutions are typically applied to silicon wafers.

The components in the cleaning solutions may be present in varying amounts. Preferably, hydrogen peroxide is present in the cleaning solutions in volume ratios ranging from about 5:1 to about 15:1 based on the volumes of hydrofluoric acid present in the cleaning solutions. The isopropyl alcohol is preferably present in the cleaning solutions in volume ratios ranging from about 40:1 to about 60:1 based on the volumes of hydrofluoric acid present in the cleaning solutions. The water is preferably present in volume ratios ranging from about 40:1 to about 60:1 based on the volumes of hydrofluoric acid present in the cleaning solutions.

The various solutions which preferably make up the cleaning solutions may contain the components in various purity amounts. In one embodiment, hydrofluoric acid is present in solutions having purities ranging from about 45 to about 55 percent. In another embodiment, hydrogen peroxide is present in solutions having a purities ranging from about 25 to about 35 percent. In another embodiment, isopropyl alcohol is present in solution having purities of about 100 percent.

The invention also relates to methods for forming cleaning solutions for application to semiconductor substrates. The methods comprise adding isopropyl alcohol, hydrogen peroxide, and hydrofluoric acid to water to form the cleaning solutions. The components are preferably added sequentially in the order listed above.

The invention also relates to methods for cleaning semiconductor substrates. The methods comprise first contacting semiconductor substrates, typically silicon wafers, having contaminants contained thereon with cleaning solutions comprising hydrofluoric acid, hydrogen peroxide, isopropyl alcohol, and water, for a predetermined period of time. Typically, organic and inorganic impurities are removed during this step. Next, the semiconductor substrates are contacted with first baths of water to remove the cleaning solutions contained on the semiconductor substrates. This step is preferably conducted as a quick dump rinse (QDR) process. The semiconductor substrates are subsequently contacted with second baths of water to remove the contaminants contained on the semiconductor substrates. The semiconductor substrates are then rotated to remove water thereon to clean the semiconductor substrates. The rotation step is preferably carried out as a spin dry process.

Preferably, the water in the cleaning solutions, the first baths, and the second baths is deionized water. The above contacting steps are preferably carried out by dipping the semiconductor substrates in the cleaning solutions, along with the first and second baths of water.

The cleaning solutions according to the present invention are highly advantageous. Relative to methods of cleaning semiconductor substrates using conventional solutions, the methods of using the cleaning solution can involve fewer steps. Accordingly, the cleaning time may be shortened and increased production of substrates may be realized. The cleaning solutions of the invention can significantly reduce the surface energy of a substrate (e.g., wafer) which helps to suppress physical behavior which typically causes contaminants to adhere to a substrate surface after the first step in a cleaning process. As a result, cleaning process efficiency may be improved. The cleaning solutions of the invention may also reduce excessive etching of a semiconductor substrate while effectively removing contaminants. As a result, the cleaning solutions can be used to clean highly integrated semiconductor devices. For example, the cleaning solutions can be employed on substrates prior to forming a gate insulating film of an MOS transistor, or a dielectric film of a capacitor. As a result, the reliability of the gate insulating film or the dielectric film may be enhanced in comparison to using conventional cleaning solutions.

The following examples are to be construed as illustrative of the present invention, and not as a limitation thereon.

EXAMPLE 1

A silicon-containing semiconductor substrate was cleaned by using a conventional cleaning solution and a cleaning solution of the present invention. The cleaning solution of the invention had a composition of deionized water, 100 percent pure isopropyl alcohol, 31 percent pure hydrogen peroxide, and 49 percent pure hydrofluoric acid present in volume ratios of 50 to 50 to 10 to 1 respectively. A dielectric film was present on the substrate in the form of a oxygen/nitrogen/oxygen film. The film was formed from a native oxide film of 10 Å, a silicon nitride film of 55 Å, and a silicon oxide film of 15 Å. The silicon oxide film was formed by thermally oxidizing the silicon nitride film.

The electric field across the dielectric film and the cumulative fail rate for the electric field were measured. In FIG. 1, the electric field values are represented on the x-axis and the cumulative fail rate values are represented on the y-axis. The curves represented by the reference characters "a" and "b" indicate the results of using a conventional cleaning solution and a cleaning solution of the present invention respectively.

According to the results, the electric field which destroys the dielectric film formed on the surface of the semiconductor substrate which was cleaned using a conventional cleaning solution was determined to be 8 MV/cm. In contrast, the electric field measured when using a cleaning solution of the present invention was determined to be 8.5 MV/cm.

According to the results, the dielectric film on the substrate cleaned using the cleaning solution of the invention advantageously breaks down at a higher voltage than the film cleaned using the conventional solution. It is believed this is due to the more effective removal of Na or Cu ions from the surface of the substrate by the cleaning solution of the invention without excessively damaging the substrate surface.

EXAMPLE 2

The $\mu$-roughness of the cleaned substrates and the lifetime of silicon atoms on the cleaned substrates described in Example 1 were measured.

The $\mu$-roughness of a semiconductor substrate generally indicates the average height of an abnormality formed on the surface of a cleaned semiconductor substrate. Typically, the more a conventional cleaning solution etches a substrate (e.g., silicon film), the rougher the substrate surface becomes.

The lifetime of silicon atoms present in the material which forms the semiconductor substrate generally indicates the time necessary to return the excited silicon atoms to an initial equilibrium state. In this instance, in order to excite the silicon atoms on the surface of the semiconductor substrate, an oxide film of approximately 120 Å was formed as a protective film on the cleaned surface of the semiconductor substrate. Subsequently, a GaAs laser having a wave length of 904 nm was irradiated onto the substrate surface. The lifetime values are significant in that when the surface of the semiconductor substrate is contaminated with metal impurities, such as Na or Cu, the time necessary for reacting the excited silicon atoms with metal atoms and returning the silicon atoms to their initial equilibrium state is very short.

Figure 2:
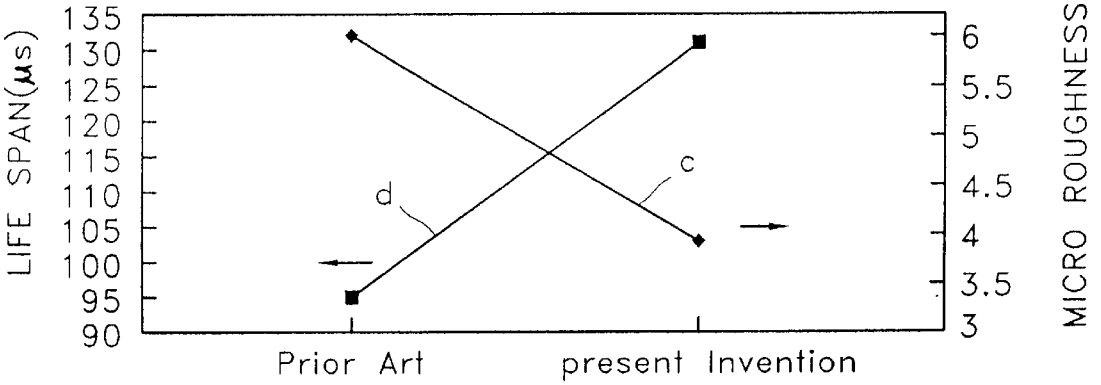
FIG. 2 is a graph illustrating the characteristics of the semiconductor substrates by using conventional cleaning processes and cleaning processes of the present invention.

The $\mu$-roughness and lifetime of the silicon atoms of the cleaned substrates were represented by reference characters "c" and "d" respectively, as shown in FIG. 2. The data shown in FIG. 2 indicates favorable $\mu$-roughness and lifetime values using the cleaning solution of the present invention, and also confirms the breakdown voltage measurements determined in Example 1.

In the drawings, specification, and examples, there have been disclosed typical preferred embodiments of the invention and, although specific terms are employed, they are used in a generic and descriptive sense only and not for purposes of limitation, the scope of the invention being set forth in the following claims.

That which is claimed:

1. A cleaning solution for application to a semiconductor substrate, said cleaning solution consisting essentially of hydrofluoric acid, hydrogen peroxide, isopropyl alcohol, and water;

wherein said hydrogen peroxide is present in said cleaning solution in a volume ratio ranging from about 5:1 to about 15:1 based on the volume of said hydrofluoric acid;

wherein said isopropyl alcohol is present in said cleaning solution in a volume ratio ranging from about 40:1 to about 60:1 based on the volume of said hydrofluoric acid; and wherein said water is present in said cleaning solution in a volume ratio ranging from about 40:1 to about 60:1 based on the volume of said hydrofluoric acid.

2. A cleaning solution according to claim 1, wherein said water was deionized before it was added to said cleaning solution.

3. A cleaning solution according to claim 1, wherein said cleaning solution is formed from a mixture of solutions, and wherein said hydrofluoric acid is present in one of the solutions in said mixture having a purity of from about 45 to about 55 percent.

4. A cleaning solution according to claim 1, wherein said cleaning solution is formed from a mixture of solutions, and wherein said hydrogen peroxide is present in one of the solutions in said mixture having a purity of from about 25 to about 35 percent.

5. A cleaning solution according to claim 1, wherein said cleaning solution is formed from a mixture of solutions, and wherein said isopropyl alcohol is present in one of the solutions in said mixture having a purity which is about 100 percent.

6. A method of cleaning a semiconductor substrate, said method comprising the steps of:

contacting a semiconductor substrate having contaminants contained thereon with a cleaning solution consisting essentially of hydrofluoric acid, hydrogen peroxide, isopropyl alcohol, and water, wherein said hydrogen peroxide is present in said cleaning solution in a volumer ratio ranging from about 5:1 to about 15:1 based on the volume of said hydrofluoric acid, wherein said isopropyl alcohol is present in said cleaning solution in a volume ratio ranging from about 40:1 to about 60:1 based on the volume of said hydrofluoric acid, and wherein said water is present in said cleaning solution in a volume ratio ranging from about 40:1 to about 60:1 based on the volume of said hydrofluoric acid;

contacting the semiconductor substrate with a first bath of water;

contacting the semiconductor substrate with a second bath of water; and rotating the semiconductor substrate to remove water remaining thereon and clean the semiconductor substrate.

7. A method according to claim 6, wherein the water present in the cleaning solution, the first bath of water, and the second bath of water was deionized prior to being added to or contacting the cleaning solution.

8. A method according to claim 6, wherein the cleaning solution is formed from a mixture of solutions, and wherein the hydrofluoric acid is present in a solution having a purity of from about 45 to about 55 percent.

9. A method according to claim 6, wherein the cleaning solution is formed from a mixture of solutions, and wherein the hydrogen peroxide is present in a solution having a purity of from about 25 to about 35 percent.

10. A method according to claim 6, wherein the cleaning solution is formed from a mixture of solutions, and wherein the isopropyl alcohol is present in a solution having a purity which is about 100 percent.

11. A method of forming a cleaning solution for application to a semiconductor substrate, said method comprising:

adding isopropyl alcohol, hydrogen peroxide, and hydrofluoric acid to water to form the cleaning solution, wherein the isopropyl alcohol, the hydrogen peroxide, and the hydrofluoric acid are added to the water sequentially, and wherein the hydrogen peroxide is present in the cleaning solution in a volume ratio ranging from about 5:1 to about 15:1 based on the volume of the hydrofluoric acid, wherein the isopropyl alcohol is present in the cleaning solution in a volume ratio ranging from about 40:1 to about 60:1 based on the volume of the hydrofluoric acid, wherein the water is present in the cleaning solution in a volume ratio ranging from about 40:1 to about 60:1 based on the volume of the hydrofluoric acid, and wherein said cleaning solution consists essentially of isopropyl alcohol, hydrogen peroxide, hydrofluoric acid, and water.

12. A cleaning solution according to claim 1, wherein said water was deionized before it was added to said cleaning solution.

* * * * *